US006799410B2

(12) United States Patent
Gamberini

(10) Patent No.: US 6,799,410 B2
(45) Date of Patent: Oct. 5, 2004

(54) CONVEYING DEVICE FOR MACHINES FOR PACKAGING ROLLS AND THE LIKE

(76) Inventor: Gianluigi Gamberini, Via Carrati 12, Bologna (IT)

( * ) Notice: Subject to any disclaimer, the term of this patent is extended or adjusted under 35 U.S.C. 154(b) by 0 days.

(21) Appl. No.: 09/989,227

(22) Filed: Nov. 20, 2001

(65) Prior Publication Data

US 2002/0059784 A1 May 23, 2002

(30) Foreign Application Priority Data

Nov. 23, 2000 (IT) ..... BO2000A0685 U

(51) Int. Cl.[7] ..... B65B 11/06

(52) U.S. Cl. ..... 53/233; 53/224; 53/257; 53/531

(58) Field of Search ..... 53/231, 233, 224, 53/257, 531; 198/803.11, 473.1

(56) References Cited

U.S. PATENT DOCUMENTS 3,631,649 A * 1/1972 Close et al. ..... 53/415
4,505,093 A * 3/1985 Johnson ..... 53/531
4,624,096 A * 11/1986 Nordstrom ..... 53/209
4,718,540 A * 1/1988 Greenwell ..... 198/620
4,854,108 A * 8/1989 Cassoli ..... 53/209
5,038,549 A * 8/1991 Nordstrom ..... 53/447
5,038,919 A * 8/1991 Harston ..... 198/626.1
5,287,679 A * 2/1994 Dall'Omo ..... 53/466
5,331,788 A * 7/1994 Cinotti ..... 53/228
5,465,550 A * 11/1995 Dall'Omo ..... 53/233
6,308,497 B1 * 10/2001 Cassoli et al. ..... 53/228

* cited by examiner

*Primary Examiner*—John Sipos
*Assistant Examiner*—Louis Tran
(74) *Attorney, Agent, or Firm*—William J. Sapone; Coleman Sudol Sapone, P.C.

(57) ABSTRACT

A conveying device for machines for packaging rolled articles includes a series of carriages, fastened, regularly spaced apart, to conveying means moved stepwise along an endless path. Each pair of adjacent carriages define holding seats for respective groups of articles to be packaged in a single pack with a sheet of a wrapping material. The carriages include a plurality of pushing prongs which extend, perpendicular to the conveying means, from slide means slidingly mounted on gliding means fastened to the conveying means crosswise to a forward movement direction of conveying means. The conveying device include also means for adjusting the position of the pushing prongs on the carriages, aimed at operating the slide means to move in a selected position along the gliding means.

5 Claims, 4 Drawing Sheets

CONVEYING DEVICE FOR MACHINES FOR PACKAGING ROLLS AND THE LIKE

TECHNICAL FIELD

The present invention relates to the technical field concerning packaging articles wound in rolls, e.g. articles of paper and the like.

In particular, the invention relates to a conveying device aimed at working in a machine for packaging roll articles and the like.

DESCRIPTION OF THE PRIOR ART

Known automatic packaging machines wrap for articles in rolls with a sheet of heat-sealing material, e.g. polythene.

The packages usually include two, four or more rolls arranged in one or more layers.

According to a known solution applied to the packaging machines, rolls to be packed are fed by a conveying device including a series of carriages, which are spaced out and fastened to chain conveying means operated stepwise along an endless path defined by guides of the carriages.

The carriages include a plurality of pushing prongs or arms, which define, between each pair of adjacent carriages, holding seats for packs of rolls to be packaged.

While being introduced in the above mentioned holding seat, located at a suitable working station of the machine, the pack of rolls strikes against a sheet of heat-sealing material, so as to become partially wrapped.

Suitable folding means complete the wrapping of the pack of rolls with the heat-sealing material sheet.

The above mentioned carriages include heads, facing each other and equipped, along their sides, with ball bearings, which move inside guides defining the above mentioned endless path of the conveying means.

In their lower part, the carriages heads have means for fastening to the links of the conveying means.

The pushing prongs are situated on each carriage, suitably spaced apart.

The number of pushing prongs on each carriage changes in relation to the number of rolls to be packaged in each pack. In order to obtain a balanced situation during the pushing step, usually at least a pair of pushing prongs are necessary on each carriage for packages formed by e.g. two rolls, placed side by side.

The packs include one or more layers of rows of rolls; each row includes one or more rolls, in the latter case, the rolls of each row are coaxial and drawn close to the heads.

The axial dimension of the rows define the length of the pack. When the packages size is to be changed, consequently, also the length of the pack must be changed, and it is necessary to substitute all the carriages on the line with other carriages, suitable for new dimensions of the packages to be formed.

In order to do so, it is necessary to remove a suitably removable element of the guide, and to operate stepwise the conveying means with low speed to release and remove, one by one, the carriages to be substituted and mount the carriages adapted to the new working cycle.

Finally, it is necessary to adjust manually the additional means of the conveying device, such as means acting as stops for the moving rolls.

The operations needed for size change require a lot of time, as well as suitably trained staff.

Moreover, it is necessary to store additional sets of carriages in a magazine, which results in bigger number of mechanical parts and consequently, increases the costs and space required for a magazine.

The document U.S. Pat. No. 5,465,550 describes a conveying device which includes carriages equipped with removable prongs for pushing rolls.

In this case, the prongs are fastened to two parallel stems which constitute the carriages in the regions of suitable connection seats.

When it is necessary to change the size of packages of rolls, it is enough to disengage the pushing prongs from the carriages, by simply rotating them, with respect to carriages, and repositioning them according to the characteristics of the new working cycle products.

In some cases, it is necessary to increase the number of pushing prongs for each carriage, to maintain stable the dragging operation.

The above mentioned device avoids the necessity of a bigger magazine, yet it requires a long out-of-working time to remove, adjust and reposition the pushing prongs.

SUMMARY OF THE INVENTION

The object of the present invention is to resolve the above mentioned problems by proposing a conveying device, in which a simple and rapid changeover can be performed in accordance to the change of the pack length, in machines for packaging rolled articles and the like.

Another object of the present invention is to propose a conveying device, which does not require additional sets of mechanical parts, necessary for size changeover, to be held in a magazine.

A further object of the present invention is to propose a conveying device, which is very simple and functional, as well as versatile and used for different types of articles to be packaged.

The above mentioned objects are obtained, in accordance with the contents of the claims, by means of a conveying device for machines for packaging articles in rolls and the like, the conveying device including:

- conveying means moved stepwise along an endless path, in a forward movement direction;
- a series of spaced out carriages fastened to said conveying means and disposed in pairs, each pair of said pairs of said adjacent carriages defining holding seats for respective groups of articles to be packaged in a single pack with a sheet of a wrapping material;
- each carriage of said carriages including:
  - gliding means fastened to said conveying means crosswise to said forward movement direction of said conveying means;
  - slide means slidingly mounted on said gliding means and located in a selected position along said gliding means of said carriages;
  - a series of pushing prongs extending, perpendicular to said conveying means, from said slide means;

means for adjusting said pushing prongs on said carriages by operating said slide means to move to a new selected position along said gliding means.

BRIEF DESCRIPTION OF THE DRAWINGS

The characteristic features of the present invention will be pointed out in the following description of a preferred, but not unique embodiment, with reference to the enclosed drawings, in which.

DETAILED DESCRIPTION OF THE INVENTION

Figures 1, 1A:
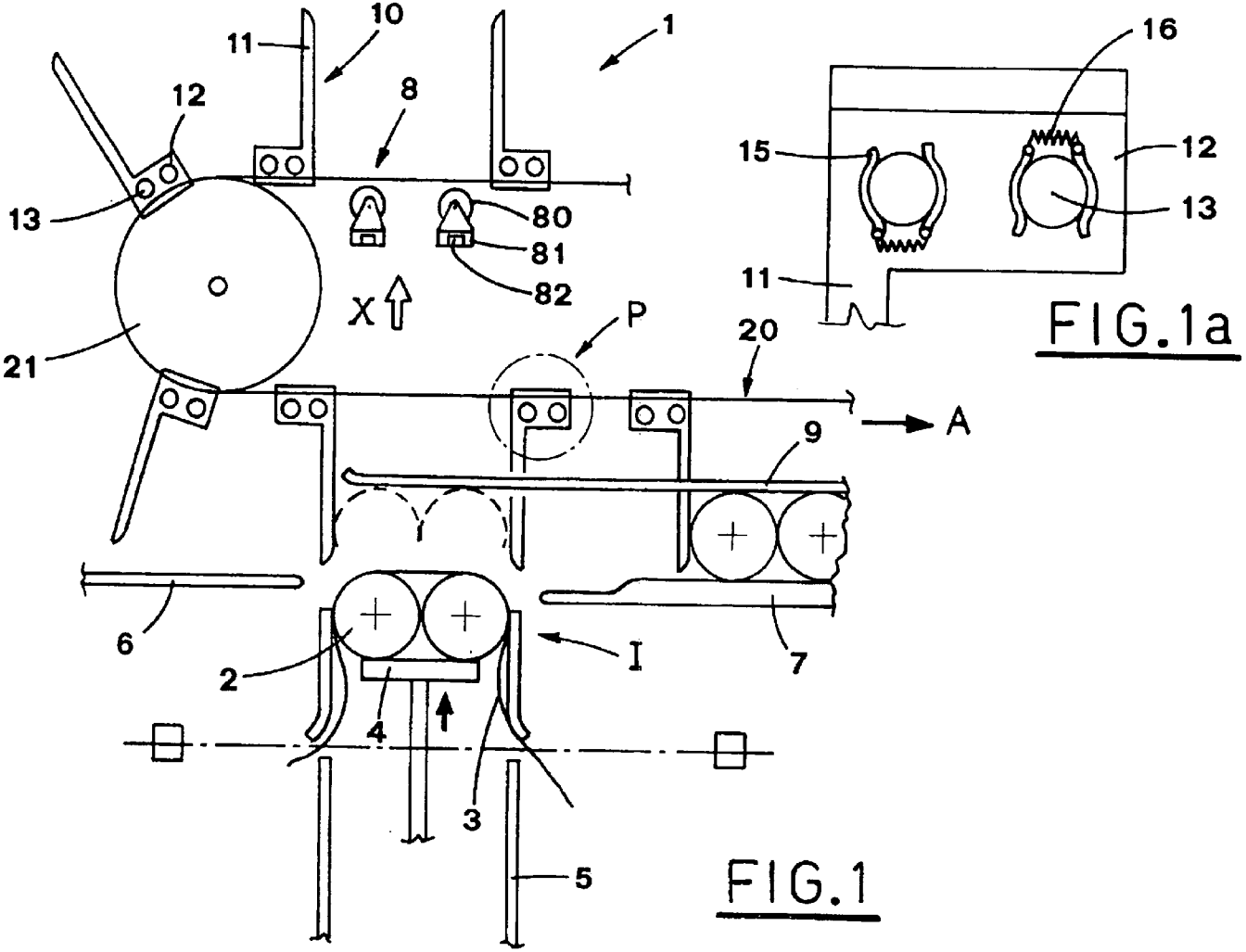
FIG. 1 is a schematic lateral view of the proposed conveying device used in a machine for packaging rolled articles.
FIG. 1*a* is an enlarged schematic view of the particular P of FIG. 1.

With reference to the above mentioned figures, the reference numeral 1 indicates the conveying device applied to a machine for packaging articles 2 in rolls, e.g. paper rolls, within a sheet of heat-sealing material 3, e.g. polythene.

The conveying device 1 includes a plurality of carriages 10, regularly spaced out and carried by conveying means 20 operated stepwise along an endless path, in the operation direction A.

The conveying means 20 are chain or toothed belt means which are mounted around pulleys 21.

The conveying device 1 defines, between each pair of adjacent carriages 10, holding seats for respective groups of rolls 2 to be packaged in single packages, e.g. including two or four rolls 2.

The rolls 2 are introduced into the above mentioned holding seats in the region of an introducing station I of the machine, by a raising member 4, which acts inside means 5 for guiding the group of rolls 2 to be moved.

While being raised by the raising member 4, the group of rolls 2 strikes against the sheet 3 of heat-sealing material, thus becoming partially wrapped therein.

Folding members 6, 7, facing each other and moving along the direction of forward movement of the conveying device 1, complete, in a known way, the wrapping of the pack of rolls 2 with the sheet 3, after the pack of rolls 2 had been introduced into the holding seat facing the station I.

The carriages 10 include a plurality of pushing prongs 11 which extend from a plurality of slides 12, perpendicular to the conveying means 20.

The slides 12 are mounted slidingly on a pair of stems 13, arranged crosswise to the direction of forward movement of the conveying means 20 and fastened to the ends of relative heads 14 of the carriage 10.

The heads 14 are equipped, along their sides, with ball bearings, not shown, which move inside grooved guides extending along an endless path.

The slides 12 are friction-locked on the stems 13 by elastic gripping means 15, e.g. jaws acted upon by a spring 16. Obviously, the slides 12 can be friction-locked on the shafts 13 by any other means.

The number of pushing prongs 11 on each carriage 10 is equal to the maximum possible number in relation to different sizes (lengths) of the packages to wrap.

In the case illustrated herein, each carriage 10 has four pushing prongs 11. However, it is possible to use a different number of pushing prongs 11, in particular a larger number.

The slides 12, supporting the pushing prongs 11 have a groove 17 made in the lower surface.

The groove 17 is located in a longitudinal median position and its front part, with respect to the forward movement direction A, has a "V"-shaped portion 17*a* which acts as an inlet section. The lower groove 17 of the slides 12 engages with means 8 for adjusting the position of pushing prongs 11 on the carriage 10. The adjusting means 8 are capable of controlling the displacement of the slides 12 to a selected position along the stems 13.

Figure 2:
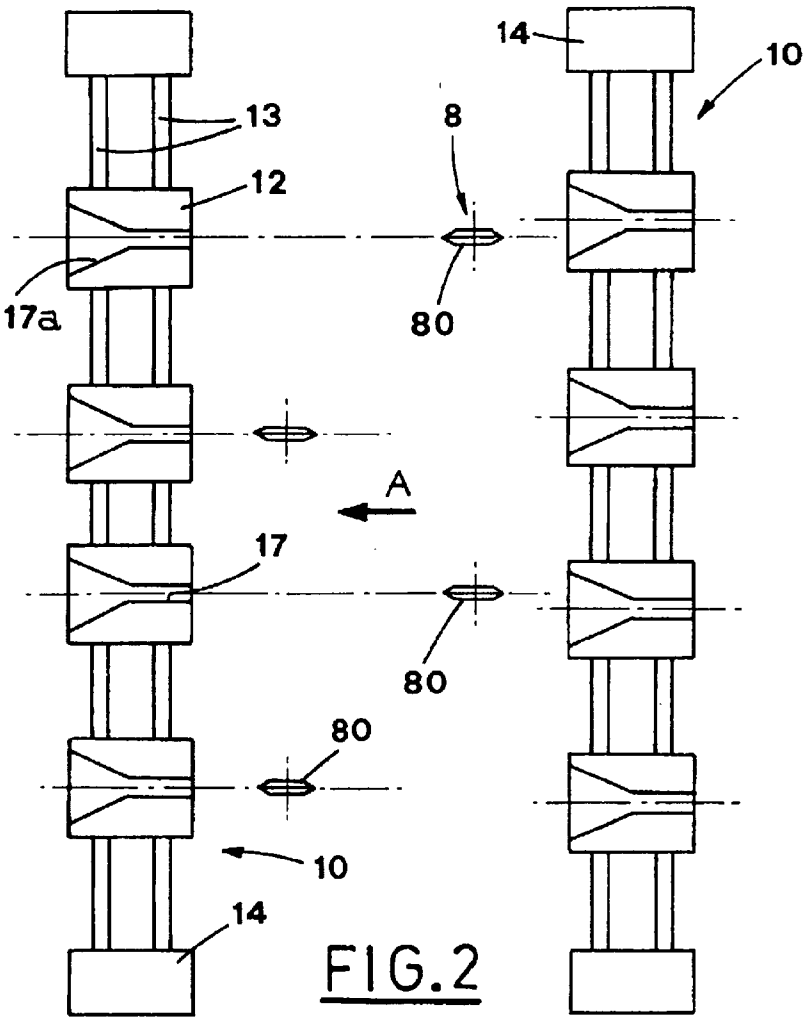
FIG. 2 is a schematic top view of the proposed conveying device, taken in accordance with the direction indicated with the arrow X in FIG. 1.

According to the solution shown in FIGS. 1, 2, the adjusting means 8 include idling wheels 80 mounted on respective supporting means 81 disposed on lines crosswise to the direction A of the conveying means 20 forward movement.

The supports 81 are driven to move with respect to guides 82 along the axis of the wheels 80, by adjusting suitably driven screw means, not shown.

The number of wheels 80 is the same as the number of the pushing prongs 11 on each carriage 10.

Therefore, in the shown example, there are four wheels 80, preferably arranged on two parallel axes, staggered with respect to one another, so as to facilitate their driving and avoid interferences.

The conveying device includes also, in correspondence to and downstream of the introduction station I, a series of constraining means 9, longitudinal and movable crosswise to the conveying device extension.

The constraining means 9 are moved automatically, by suitable actuators, in relation to the packages height change.

The operation of the conveying device appears easy to understand from the following description.

The adjusting wheels 80 are moved gradually, in relation to the size of packages to be obtained, to the selected position for the pushing prongs 11, operating simultaneously the conveying means 20 supporting the carriages 10.

The wheels 80 engage with the respective grooves 17 made in the lower surface of the slides 12 of the pushing prongs 11, thanks to the inlet section 17*a* of the grooves 17, making the slides 12 glide along the stems 13, as seen in FIG. 2.

Thus, the pushing prongs 11 are gradually moved crosswise along each carriage 10, until they take the desired position.

In particular, in case there are four pushing prongs 11 on each carriage 10, as shown in the example, it is possible to bring the slides 12 to a first position, in which the distance between the adjacent slides 12 is minimum, or alternatively, to a second position, in which the distance between the adjacent slides 12 is maximum.

In the first position, the pushing prongs 11 are close to each other, so as to engage the length of only one roll 2; while in the second position, the pushing prongs 11 are suitably far and engage the length of a pair, respectively a first and a second, aligned rolls 2.

Therefore, the described conveying device achieves the objects of simple and rapid size changeover in machines for packaging rolled articles and the like.

Actually, the device does not require the substitution of the carriages mounted on the conveying means, but it allows to just adjust the transversal position of each pushing tooth 11 on the carriage by its sliding.

This adjustment is performed automatically in a limited period of time and does not necessitate removing of any part of the device.

Consequently, another advantage of the proposed conveying device derives from the fact that no additional sets of mechanical parts are required for size changeover, to be stored in a magazine.

Actually, each carriage is equipped with the maximum possible number of pushing prongs.

Obviously, the number of pushing prongs can differ in relation to different use needs.

Figure 3:
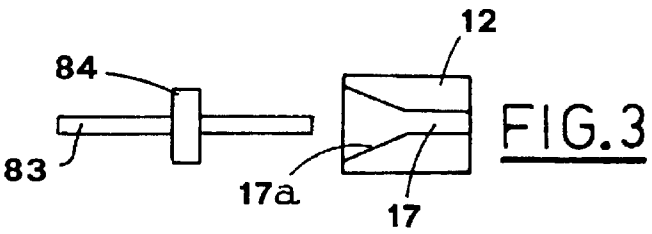
FIGS. 3, 4 and 5 are schematic top views of corresponding embodiments of the means for adjusting the position of the pushing prongs of the proposed device.

FIG. 3 shows a different embodiment of adjustment means, according to which the grooves 17 of the slides 12 engage with respective longitudinal rods 83, which are fastened to relative slides 84 moving crosswise to the direction of the carriages forward movement.

Figure 4:
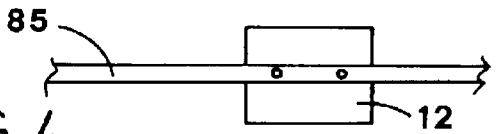

According to the embodiment shown in FIG. 4, the adjusting means include flexible means 85, e.g. endless chains or belts, which are trained a close loop path corresponding to the one defined by the conveying means 20.

The lower part of the flexible means 85 is fastened to the slides 12.

The flexible means 85 are trained around pulleys, which are moved crosswise to the forward movement direction A, so as to operate the slides 12 in a movement with respect to the stems 13.

Figure 5:
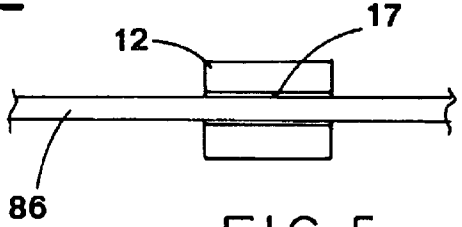

According to a further embodiment, shown in FIG. 5, the adjusting means include bars 86, which are shaped like the close loop path of the conveying means 20 and move crosswise to the forward movement direction A.

The bars 86 engage continuatively the grooves 17 of the respective slides 12, so as to determine the position assumed by the pushing prongs 11 with respect to the carriage 10.

Figure 7:
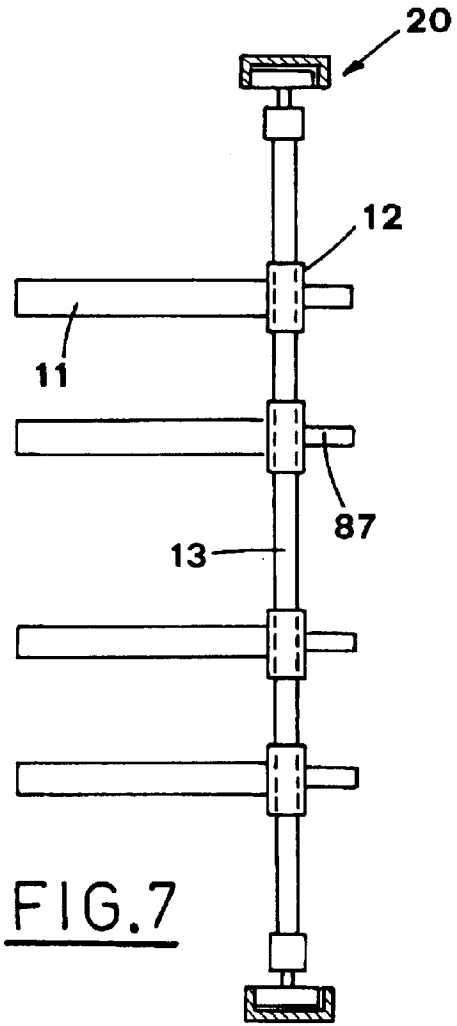
FIGS. 6, 7 are schematic, respectively top and front views, of another embodiment of the proposed conveying device.
Figure 6:
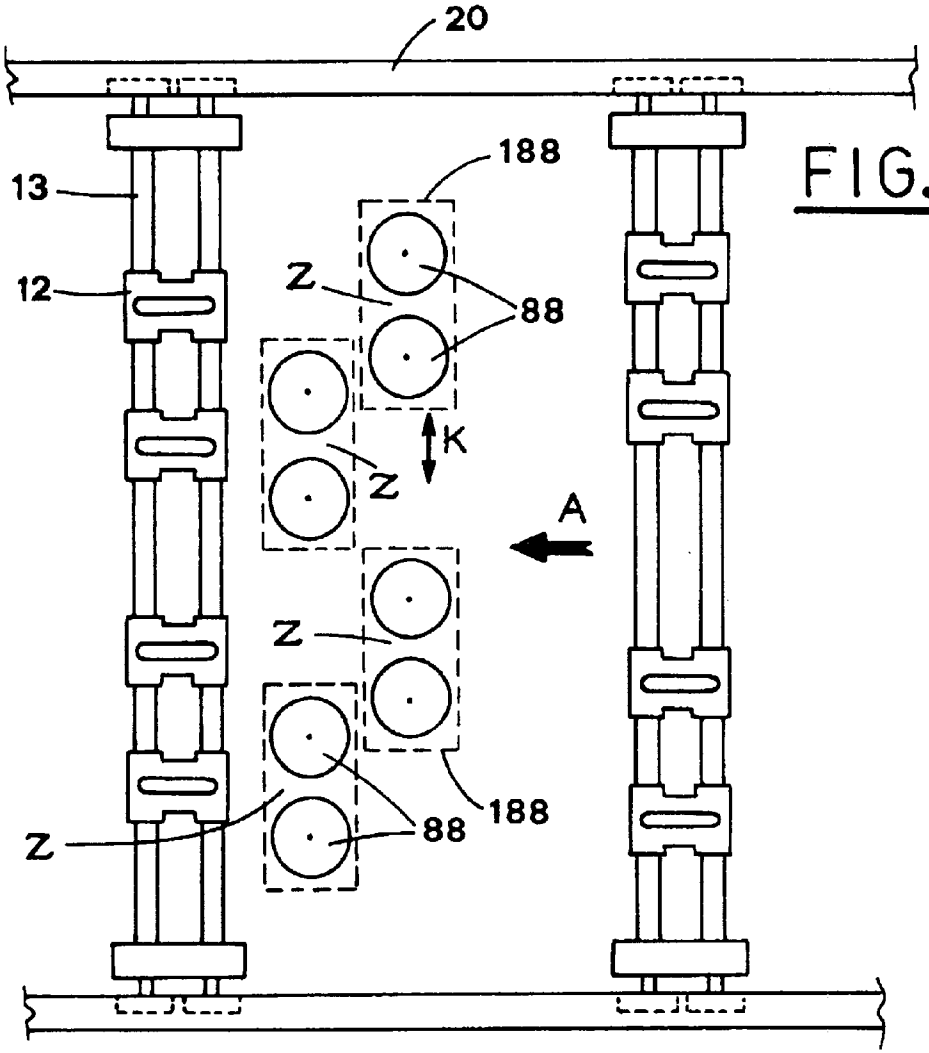

FIGS. 6, 7 show a still different embodiment of the adjusting means, according to which each slide 12 of the relative carriage 10 is equipped with at least one guiding extension 87, which protrudes substantially orthogonal from the slide 12, parallel to the corresponding pushing prongs 11, on the opposite part.

Each extension 87 of the slides 12 engage with corresponding adjusting means, which in this case include pairs of idling rollers 88, carried by relative supports 188, which are orthogonal to the movement plane of the carriages 10 (FIG. 7).

The adjustment of the transversal position of each slide 12 is ensured by the engagement of the corresponding extensions 87 in the area Z defined by the pairs of adjacent rollers 88 (FIG. 6).

The position of each slide 12 is adjusted by moving the corresponding supports 188 crosswise with respect to the forward movement direction A, in the direction K.

Figure 8:
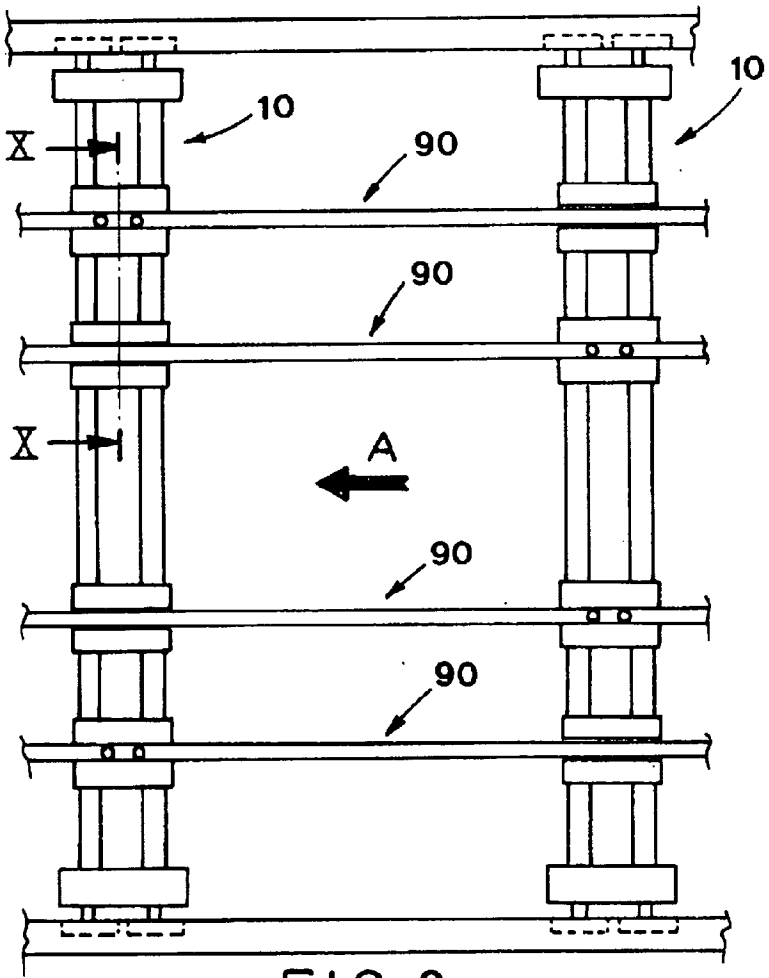

According to the solution shown in FIG. 8, the adjusting means include transmission means 90, e.g. endless toothed belts or chains, which are trained around pulleys moving crosswise with respect to the forward movement direction A, along a close loop path defined by the guides on which the heads 14 of the carriages 10 work.

The transmission means 90 are alternately fastened to and engaged with respective slides 12 disposed side by side and mounted on adjacent carriages 10.

This means that, for each carriage 10, the slides 12 are alternately engaged and fastened with respective adjacent transmission means 90.

Figure 10:
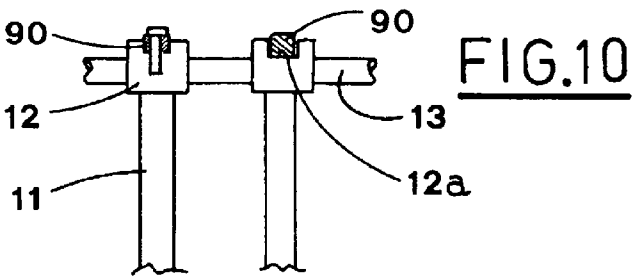
FIG. 10 is a schematic section view taken along the line X—X indicated in FIG. 8.

What above is pretty clear from the FIG. 10, where it is well seen how the slide 12 on the left is firmly fastened to the respective transmission means 90, while the adjacent transmission means 90 freely pass through the groove 12*a* made in the slide 12 on the right.

This way, it is possible to move the carriages in the forward movement direction A directly by the transmission means 90, allowing at the same time a transversal adjustment of the position of each slide 12 with respect to the respective carriage 10, which is necessary to adapt the conveying device 1 to the different size (length) of the articles 2.

Moreover, in these conditions, longitudinal adjustment of the position of the subsequent carriages 10 is also particularly easy, thus facilitating adapting to the change of size of the articles 2, in particular of their width.

Figure 9:
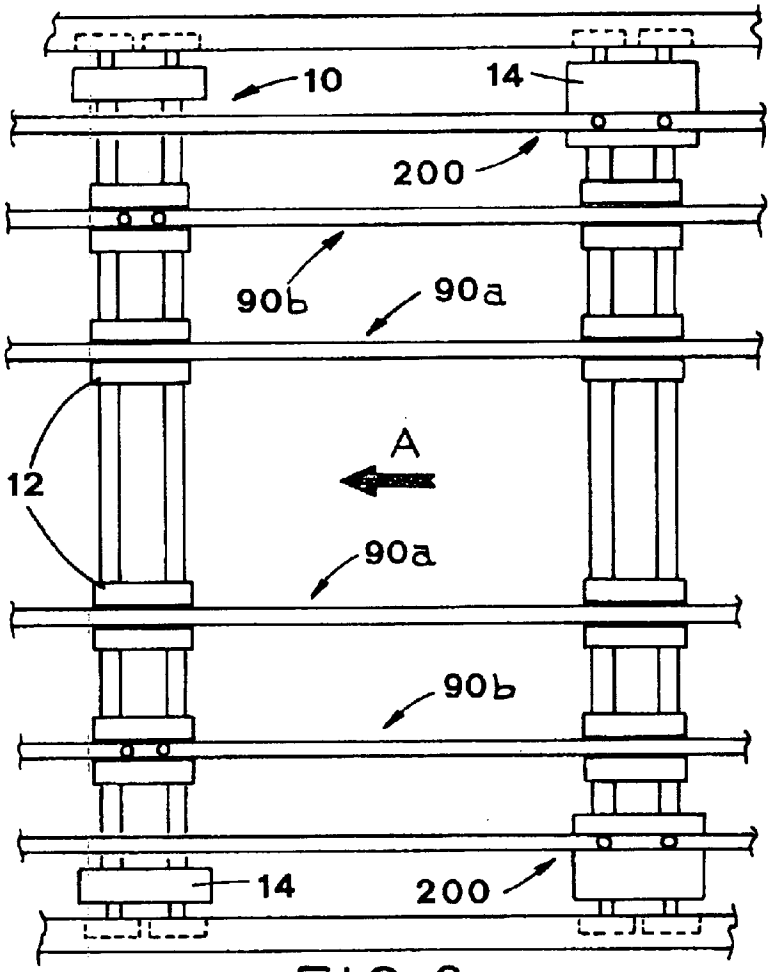
FIGS. 8, 9 are schematic top views of further embodiments of the proposed conveying device.

FIG. 9 shows a variant of the conveying device 1 shown in FIG. 8, according to which the adjusting means 90*a*, 90*b* include transmission means which alternatively are fastened and engage with the slides 12 of subsequent carriages 10.

In this particular case, however, the transmission means 90*a* are aimed only at adjusting transversely the slides 12, and other transmission means 90*b* are aimed both at longitudinally adjusting the slides 12 and at driving the corresponding carriages 10.

Consequently, the carriages 10 including only the slides 12 only engaging with the transmission means 90*a*, thus excluding the driving task of the latter, are driven to move in the forward movement direction A by driving means 200, of known type, situated in correspondence to the heads 14.

This technical-functional aspect substantially avoids vibration and oscillation of the packs of rolls with respect to their width, i.e. crosswise to the forward movement direction A. With reference to the above embodiments, it is understood that the slides 12 can be firmly held by friction on the stems 13, by means of the described gripping means 15, or other means performing the same stabilizing function, in all these cases, in which there is the risk of undesired gliding movement of the slides 12 with respect to the stems 13, e.g. due to vibration or casual pushes.

In cases, in which the slides 12 engage continuatively with the transmission means 90, the above risk is most probably outweighed, thus the stabilization of the gripping means 15 on the slides 12 is not particularly needed.

It is understood that what above, has been described as a pure, not limitative example, therefore, possible variants of the invention remain within the protective scope of the present technical solution, as described above and claimed hereinafter.

What is claimed is:

1. A conveying device for machines for packaging articles in rolls, the conveying device comprising:

conveying means moved stepwise along an endless path, in a forward movement direction;

a series of spaced out carriages fastened to said conveying means and disposed in pairs, each pair of said pairs of said adjacent carriages defining holding seats for respective groups of articles to be packaged in a single pack with a sheet of a wrapping material;

each carriage of said carriages including:

gliding means fastened to said conveying means crosswise to said forward movement direction of said conveying means;

slide means slidingly mounted on said gliding means and located in a selected position along said gliding means of said carriages;

a series of pushing prongs extending, perpendicular to said conveying means, from said slide means;

means for adjusting said pushing prongs on said carriages during operation of the machine by moving said slide means to a new selected position along said gliding means; said means for adjusting the position of the slide means including endless transmission means, which are located around a close loop path and move crosswise to said forward movement direction, said transmission means being alternately fastened and in engagement with corresponding slide means of subsequent carriages, facing each other.

2. A device as in claim 1 wherein the number of said pushing prongs on each carriage is the maximum possible, in relation to the dimensions of the groups of articles to be packaged in a pack.

3. A device as in claim 1 wherein said slide means are kept by friction on said gliding means by elastic gripping means.

4. A device as in claim 1 wherein said means for adjusting the position of the pushing prongs engage with respective longitudinal grooves made on said slide means.

5. A device as in claim 1 wherein said gliding means include a pair of stems, which are arranged crosswise to said forward movement direction of the conveying means and having opposite ends fastened to said carriages, said carriages sliding on guiding means following a close loop path.

* * * * *